US011222597B2

(12) United States Patent
Bong et al.

(10) Patent No.: US 11,222,597 B2
(45) Date of Patent: Jan. 11, 2022

(54) DISPLAY DEVICE AND METHOD FOR CONTROLLING SAME

(71) Applicant: LG Display Co., Ltd., Seoul (KR)

(72) Inventors: Seungjong Bong, Paju-si (KR); Junghoon Seo, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/123,477

(22) Filed: Dec. 16, 2020

(65) Prior Publication Data

US 2021/0201815 A1 Jul. 1, 2021

(30) Foreign Application Priority Data

Dec. 27, 2019 (KR) ..... 10-2019-0176068

(51) Int. Cl.
*G09G 3/32* (2016.01)
*G09G 3/3266* (2016.01)

(52) U.S. Cl.
CPC ... *G09G 3/3266* (2013.01); *G09G 2310/0202* (2013.01); *G09G 2310/08* (2013.01); *G09G 2320/0233* (2013.01); *G09G 2320/0257* (2013.01); *G09G 2320/04* (2013.01); *G09G 2330/02* (2013.01)

(58) Field of Classification Search
CPC ..... G09G 3/2085; G09G 3/2092; G09G 3/32; G09G 3/3208; G09G 3/3266; G09G 2310/0202; G09G 2310/0221; G09G 2310/0264; G09G 2310/0278; G09G 2310/08; G09G 2320/0233; G09G 2320/0257; G09G 2320/0276; G09G 2320/0285; G09G 2320/04; G09G 2320/043; G09G 2320/045; G09G 2330/12; G09G 2330/02; G09G 2330/027
See application file for complete search history.

(56) References Cited

U.S. PATENT DOCUMENTS

2011/0141090 A1* 6/2011 Hong ..... G09G 3/3426 345/211
2014/0104258 A1* 4/2014 Oh ..... G09G 3/3233 345/211
2016/0189620 A1* 6/2016 Park ..... G09G 3/3258 345/690

(Continued)

FOREIGN PATENT DOCUMENTS

KR 10-1970573 B1 8/2019
KR 10-2017673 B1 9/2019

*Primary Examiner* — Michael J Eurice
(74) *Attorney, Agent, or Firm* — Fenwick & West LLP

(57) ABSTRACT

Disclosed herein are a display device and a method for controlling the same, and more particularly, to a display device and a method for controlling the same that may compensate degradation of a display panel and may improve image quality. According to the method for controlling the display device of an embodiment, a pattern image is displayed respectively on a plurality of scan blocks set on the display panel. When the pattern image is displayed respectively on the plurality of scan blocks set on the display panel, a current value of each scan block is measured. Then a representative current value is compared with a predetermined reference value, and it is determined whether compensation data of each pixel included in each of the scan blocks is updated.

12 Claims, 8 Drawing Sheets

(56) References Cited

U.S. PATENT DOCUMENTS

| | | | | |
|---|---|---|---|---|
| 2016/0343302 | A1* | 11/2016 | Han | G09G 3/3233 |
| 2018/0182278 | A1* | 6/2018 | Kim | G09G 3/2018 |
| 2020/0251045 | A1* | 8/2020 | An | H02H 1/0007 |

* cited by examiner

DISPLAY DEVICE AND METHOD FOR CONTROLLING SAME

CROSS-REFERENCE TO RELATED APPLICATION

This application claims priority to and the benefit of Republic of Korea Patent Application No. 10-2019-0176068, filed on Dec. 27, 2019, the disclosure of which is incorporated herein by reference in its entirety.

BACKGROUND

1. Field

The present disclosure relates to a display device and a method for controlling the same, and more particularly, to a display device and a method for controlling the same that may compensate for degradation of a display panel and may improve image quality.

2. Background

Typical examples of a display device may include a liquid crystal display (LCD) device, a plasma display panel (PDP) device, a field emission display (FED) device, an electro luminescence display (ELD) device, an electro-wetting display (EWD) device, an organic light emitting display (OLED) device and the like.

Among them, the organic light emitting display device displays an image through pixels including an organic light emitting diode that is a self-emitting element. Accordingly, the organic light emitting display device has a smaller thickness, a wider viewing angle and a faster reaction speed than any other display device. However, the pixels of the organic light emitting display device are degraded for different reasons. In case a display panel is degraded due to degradation of each pixel, an after image or luminance non-uniformity can occur, causing a deterioration of image quality. Accordingly, various technologies have been applied to compensation of the degradation of the pixels of the organic light emitting display device.

An external compensation method by which compensation is made outside the pixels is used to compensate the degradation of the display panel. In terms of the external compensation method, threshold voltage or mobility of a driving transistor is sensed, in a state where electric current flowing in the organic light emitting diode is blocked, and based on the sensed data, compensation data is generated for compensating the degradation of the pixels.

In order for the above-described external compensation to be applied, a basic pixel circuit of the display panel needs to be additionally provided with a transistor and signal line for sensing threshold voltage or mobility of the driving transistor. Accordingly, a configuration of a circuit of the pixel becomes complex. Additionally, in terms of the external compensation method, a complex process of sensing threshold voltage or mobility of the driving transistor needs to be added in addition to a basic control process for displaying an image. Accordingly, performance of the display device is impeded, and costs incurred for manufacturing the display device and complexity in design of the display device are increased.

SUMMARY

The present disclosure is directed to a display device and a method for controlling the same that may compensate degradation of each pixel without a configuration of an additional circuit for applying an external compensation method.

The present disclosure is also directed to a display device and a method for controlling the same that may compensate degradation of a pixel with a simpler structure through a simpler control process, thereby enabling a reduction in manufacturing costs and in complexity in design.

Aspects of the present disclosure are not limited to the above-described ones. Additionally, other aspects and advantages that have not been mentioned may be clearly understood from the following description and may be more clearly understood from embodiments. Further, it will be understood that the aspects and advantages of the present disclosure may be realized via means and combinations thereof that are described in the appended claims.

According to a method for controlling a display device of an embodiment, a pattern image may be displayed respectively in a plurality of scan blocks set on a display panel. Each scan block may comprise one or more pixels. A single-color image having a predetermine color and gradation value may be set as the pattern image. However, another image may be used as the pattern image depending on embodiments.

When the pattern image is displayed respectively on the plurality of scan blocks set on the display panel, a current value of each of the scan blocks may be measure. On the basis of the current value of each of the scan blocks, a representative current value may be determined. In an embodiment of the present disclosure, the representative current value may be a maximum value or a minimum value among differences between the current values of the scan blocks and a prestored reference current value, or may be an average value of the differences, but not be limited.

Then the representative current value may be compared with a predetermined reference value and it may be determined whether compensation data of each pixel included in each of the scan blocks is updated.

When it is determined to update the compensation data, a gain value of each pixel included in each of the scan blocks may be determined on the basis of the current value of each of the scan blocks. In an embodiment of the disclosure, the step of determining a gain value of each pixel included in each of the scan blocks may comprise calculating an average value of the currents values of the scan blocks, determining a gain value of each of the scan blocks on the basis of the average value, and determining a gain value of each pixel included in each of the scan blocks on the basis of the gain value of each of the scan blocks. Further, in an embodiment of the disclosure, the gain value of each of the scan blocks may be interpolated.

Thus, the compensation data of each pixel may be updated on the basis of the gain value of each pixel.

In an embodiment of the disclosure, displaying a pre-pattern image respectively in a plurality of pre-scan blocks set on the display panel, measuring a current value of each of the pre-scan blocks when the pre-pattern image is displayed, and setting the plurality of scan blocks in at least one pre-scan block selected on the basis of the current value of each of the pre-scan blocks may be further comprised.

A display device according to an embodiment comprises a display panel comprising a plurality of pixels, a data driver configured to drive a data line of the display panel, a gate driver configured to drive a gate line of the display panel, a timing controller configured to control driving of the data driver and the gate driver, and a power supply configured to supply a power voltage to the display panel, and a current scan circuit connected between the display panel and the power supply and configured to measure magnitude of current flowing in the display panel when an image is displayed on the display panel.

The timing controller in an embodiment of the disclosure is configured to determine a representative current value on the basis of a current value of each scan block, which is measured when a pattern image is respectively displayed on a plurality of scan blocks set on the display panel, to determine whether to update compensation data of each pixel included in each of the scan blocks on the basis of the representative current value, to determine a gain value of each pixel included in each of the scan blocks on the basis of the current value of each of the scan blocks when it is determined to update the compensation data, and to update the compensation data of each pixel on the basis of the gain value of each pixel.

According to an embodiment of the present disclosure, degradation of each pixel may be compensated without a configuration of an additional circuit for applying an external compensation method of the related art.

According to an embodiment of the present disclosure, degradation of a pixel may be compensated with a simpler structure through a simpler control process, thereby enabling a reduction in manufacturing costs and in complexity in design of a display device.

BRIEF DESCRIPTION OF THE DRAWINGS

The accompanying drawings constitute a part of this specification, illustrate one or more embodiments of the present disclosure, and together with the specification, explain the present disclosure, wherein.

DETAILED DESCRIPTION

Figure 1:
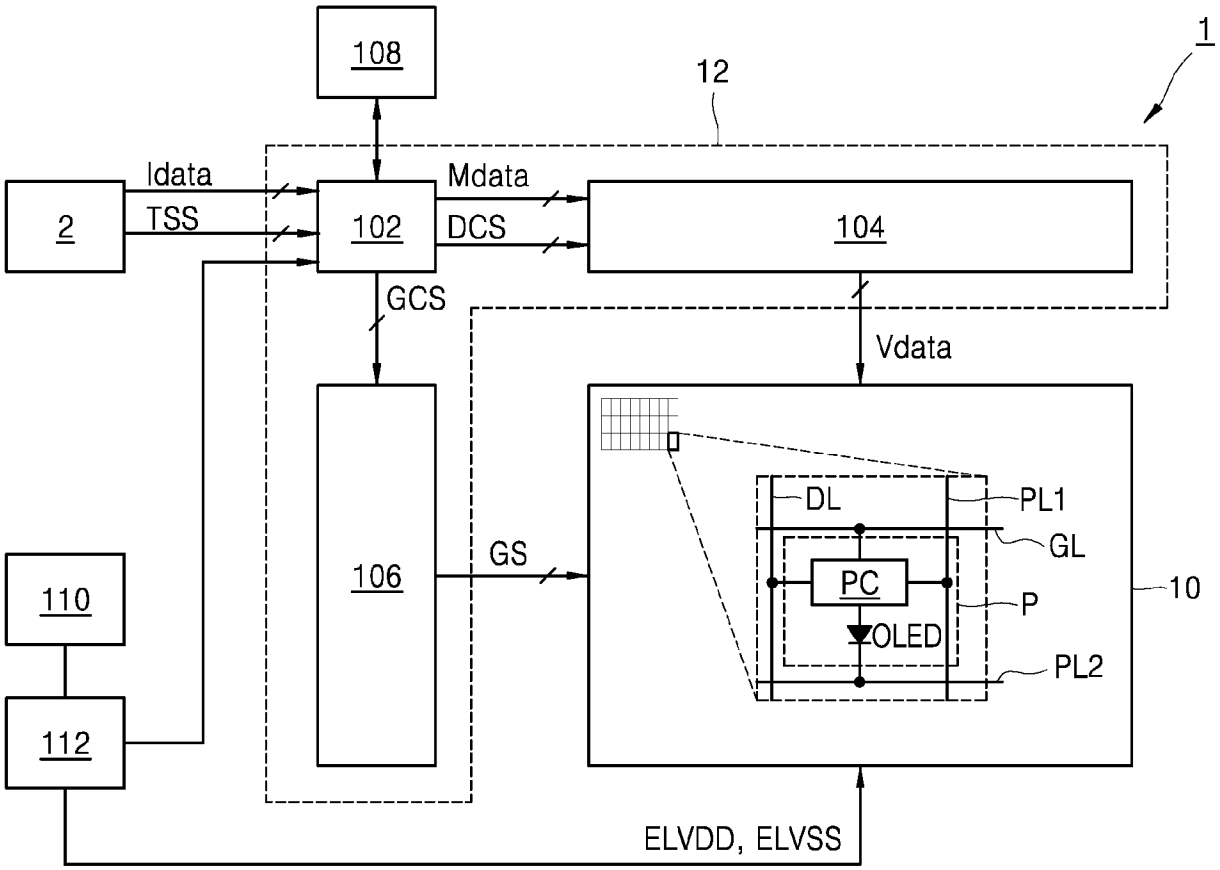
FIG. 1 illustrates a configuration of a display device according to an embodiment.

Advantages and features of the present disclosure and a method of achieving the same may be clearly understood from embodiments that are described with reference to the accompanying drawings. The present disclosure, however, may be implemented in various different forms, and should not be construed as being limited only to the embodiments set forth herein. Rather, these embodiments are provided as examples so that the present disclosure may be thorough and complete and that the scope of the disclosure will be fully conveyed to one having ordinary skill in the art to which the disclosure pertains. The present disclosure should be defined only according to the scope of the appended claims.

The shapes, sizes, ratios, angles and number of components illustrated in the drawings for describing the embodiments of the present disclosure are given only as examples, and the present disclosure is not limited to details set forth herein. Throughout the specification, like reference numerals denote like components. In describing the present disclosure, detailed description of well-known technologies including related arts will be omitted if it is deemed to make the gist of the disclosure unnecessarily vague. Throughout the specification, unless explicitly indicated otherwise, terms "comprise", "have", "including" and the like should imply the inclusion of any other component but not the exclusion of any other component, and the singular forms "a", "an" and "the" are intended to include the plural forms as well.

In describing a component, the margin of error should be considered though not explicitly described.

In describing components of the present disclosure, terms such as first, second and the like may be used. These terms are only intended to distinguish a component from another component, and the components are not limited by such terms. Certainly, a first component described below may be a second component within the technical spirit of the disclosure.

Features of various embodiments of the disclosure may be partially or entirely mixed or combined, and may be technically linked and driven in various ways. Further, embodiments may be implemented independently, or in connection with each other.

FIG. 1 illustrates a configuration of a display device according to an embodiment.

Referring to FIG. 1, the display device 1 may comprise a display panel 10 and a panel driver 12.

The display panel 10 allows an organic light emitting diode (OLED) of each pixel (P) to emit light on the basis of a data voltage (Vdata) supplied by the panel driver 12. An image corresponding to the data voltage (Vdata) may be displayed on the display panel 10 by light emitted from each pixel (P).

The display panel 10 may comprise n (n denotes natural numbers) numbers of data lines (DL) and m (m denotes natural numbers) numbers of gate lines (GL) that cross each other to define a pixel area. The display panel 10 may comprise a plurality of first power source voltage lines (PL1) formed in parallel with n numbers of data lines (DL) and connected to each pixel (P), and a second power source voltage line (PL2) connected to each pixel (P).

N numbers of data lines (DL) and m numbers of gate lines (GL) may cross each other while respectively spaced a predetermined distance from each other. M numbers of gate lines (GL) may respectively form m numbers of horizontal lines of the display panel 10.

The plurality of first power source voltage lines (PL1) may be formed in parallel with n numbers of data lines (DL) such that the plurality of first power source voltage lines (PL1) are respectively adjacent to n numbers of data lines (DL), and may receive a first power source voltage (ELVDD) from a power supply (not illustrated). The second power source voltage line (PL2) may be supplied with a low potential voltage level or a ground voltage level of a second power source voltage (ELVSS) lower than the first power source voltage (ELVDD).

A plurality of pixels (P) may respectively emit light having luminance corresponding to a data voltage (Vdata) supplied by the data line (DL) to which each pixel (P) connects, in response to a gate signal (GS) supplied by the gate line (GL) to which each pixel (P) connects. Each of the plurality of pixels (P) may comprise any one of red, green, blue and white pixels. In an embodiment, a unit pixel, which displays a single-color image, may comprise adjacent red, green and blue pixels or adjacent red, green, blue and white pixels.

Each of the plurality of pixels (P) may comprise an organic light emitting diode (OLED) and a pixel circuit (PC).

The organic light emitting diode (OLED) may connect between the pixel circuit (PC) and the second power source voltage line (PL2) and may emit light in proportion to a data current supplied by the pixel circuit (PC). The organic light emitting diode (OLED) may comprise an anode electrode (or a pixel electrode) connected to the pixel circuit (PC), a cathode electrode (or a reflection electrode) connected to the second power source voltage line (PL2), and an organic layer formed between the anode electrode and the cathode electrode. The organic layer may have a hole transport layer/an organic light emitting layer/an electron transport layer structure or a hole injection layer/a hole transport layer/an organic light emitting layer/an electron transport layer/an electron injection layer structure. The organic layer may further comprise a functional layer for improving light emission efficiency and/or a life span and the like of the organic light emitting layer.

The pixel circuit (PC) may respond to a gate signal (GS) supplied from the panel driver 12 to the gate line (GL), and on the basis of a data voltage (Vdata) supplied from the panel driver 12 to the data line (DL), may control currents flowing from a corresponding first power source voltage line (PL1) to the organic light emitting diode (OLED). To this end, the pixel circuit (PC) may comprise a driving transistor (not illustrated) configured to control currents flowing from the first power source voltage line (PL1) to the organic light emitting diode (OLED) on the basis of a data voltage (Vdata), a switching transistor (not illustrated) configured to supply a data voltage (Vdata) to a gate electrode of the driving transistor, and a storage capacitor (not illustrated) connected between the gate electrode and a source electrode of the driving transistor and configured to maintain a gate source voltage of the driving transistor for a single frame.

The panel driver 12 may comprise a timing controller 102, a data driver 104 and a gate driver 106.

The timing controller 102 may receive a vertical synchronization signal, a horizontal synchronization signal, a data enable signal, a timing synchronization signal (TSS) including a main clock and the like and input image data (Idata) which are output from a host system 2.

The timing controller 102 may generate a gain value for updating compensation data of each pixel (PC) that constitutes the display panel 10. The timing controller 102 may update the compensation data of each pixel (PC), which are stored in a memory 108, using the generated gain value. The memory 108 may store initial compensation data that is generated before shipment of the display device 1, and when the display device 1 is driven, the compensation data stored in the memory 108 may continue to be updated by the gain value generated by the timing controller 102.

In an embodiment, the timing controller 102 may determine a representative current value on the basis of a current value of each scan block, which is measured when each pattern image is displayed on a plurality of scan blocks set on the display panel 10. The timing controller 102 may determine whether to update the compensation data of each pixel included in each of the scan blocks on the basis of the determined representative current value. When determining to update the compensation data, the timing controller 102 may determine a gain value of each pixel included in each of the scan blocks on the basis of a current value of each of the scan blocks, and may update the compensation data of each pixel on the basis of the gain value of each pixel.

Additionally, in an embodiment, the timing controller 102 may set a plurality of scan blocks in at least one pre-scan block selected on the basis of a current value of each pre-scan block, which is measured when each pre-pattern image is displayed in a plurality of pre-scan blocks set on the display panel 10.

In an embodiment, the representative current value may be set to a highest value or a lowest value among differences between current values of scan blocks and a prestored reference current value, or may be set to an average value of the differences.

In an embodiment, the timing controller 102 may compare the representative current value with a predetermined reference value, and when the representative current value is higher than or equal to the reference value, may determine to update the compensation data of each pixel included in each scan block. When the representative current value is lower than the reference value, the timing controller 102 may determine not to update the compensation data of each pixel included in each scan block.

Additionally, in an embodiment, the timing controller 102 may calculate an average value of current values of scan blocks, and on the basis of the average value, may determine a gain value of each scan block, and on the basis of the gain value of each scan block, may determine a gain value of each pixel included in each scan block.

Further, in an embodiment, the time controller 102 may interpolate a gain value of each scan block and may determine a gain value of each pixel included in each scan block.

The timing controller 102 may modulate input image data (Idata) using compensation data stored in the memory 108 and may transmit the modulated input image data (Mdata) to the data driver 104.

The timing controller 102 may also generate a gate control signal (GCS) for controlling the gate driver 106 and a data control signal (DCS) for controlling the data driver 104 respectively using a timing synchronization signal (TSS).

The data driver 104 may receive the data control signal (DCS) and the modulated input image data (Mdata) supplied by the timing controller 102. The data driver 104 may also receive a plurality of different reference gamma voltages from a reference gamma voltage generator (not illustrated). The data driver 104 may sample the modulated input image data (Mdata), input on the basis of a unit of 1 horizontal line, on the basis of the data control signal (DCS), may convert the sampled data into an analogue-type data voltage (Vdata) on the basis of the plurality of reference gamma voltages, and may supply the analogue-type data voltage to the data line (DL) of each pixel (P).

The gate driver 106 may generate a gate signal (GS) for data addressing in response to the gate control signal (GCS) supplied by the timing controller 102, and may supply the gate signal (GS) consecutively to m numbers of gate lines (GL). The gate driver 106 may comprise a shift register that consecutively outputs a gate signal (GS) on the basis of the gate control signal (GCS).

A power supply 110 may connect to a power supply device outside the display device 1 and may respectively generate a first power source voltage (ELVDD) and a second power source voltage (ELVSS) on the basis of an external power source supplied by the power supply device. The first power source voltage (ELVDD) and the second power source voltage (ELVSS) may be respectively supplied to the display panel 10 and may be used to drive the display panel 10.

A current scan circuit 112 may connect between the power supply 110 and the display panel 10. The current scan circuit 112 may measure magnitude of current flowing in the display panel 10, i.e., a value of current of the display panel 10 when an image is displayed on the display panel 10. The current scan circuit 112 may communicate with the timing controller 120 and may deliver the current value of the display panel 10 to the timing controller 102.

Figure 2:
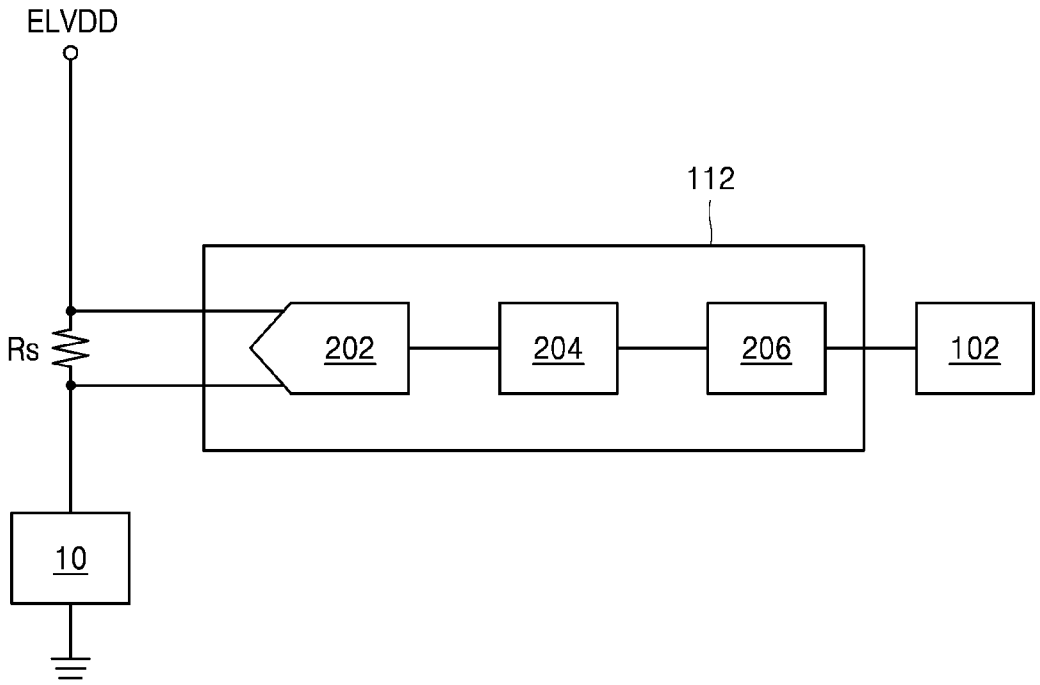
FIG. 2 illustrates a configuration of a current scan circuit according to an embodiment.

FIG. 2 illustrates a configuration of a current scan circuit according to an embodiment.

The current scan circuit 112, as illustrated in FIG. 2, may comprise an analog-digital converter 202, a register 204, a communication circuit 206.

The analog-digital converter 202 may receive magnitude of current flowing in shunt resistance (Rs) connected between the power supply (not illustrated) and the display panel 10. The analog-digital converter 202 may convert a magnitude of current input in analog form into a current value in digital form. The converted current value may be stored in the register 204.

The register 204 may store a set value required for an operation of measuring current of the current scan circuit 112. The set values stored in the register 204 may include a current value measuring timing, a current value measuring frequency and the like but not be limited. The current scan circuit 112 may measure a magnitude of current flowing in the shunt resistance (Rs) according to the timing and frequency set on the basis of the set value stored in the register 204.

The communication circuit 206 may communicate with the timing controller 102 in accordance with a predetermined standard, and may transmit the current value stored in the register 204 to the timing controller 102. The I2C communication standard for communication between integrated circuits (IC) may be an example of the communication standard for communication between the communication circuit 206 and the timing controller 102 but not be limited.

Hereinafter, a method for controlling a display device according to various embodiments is described with reference to other drawings along with FIGS. 1 and 2.

Figure 3:
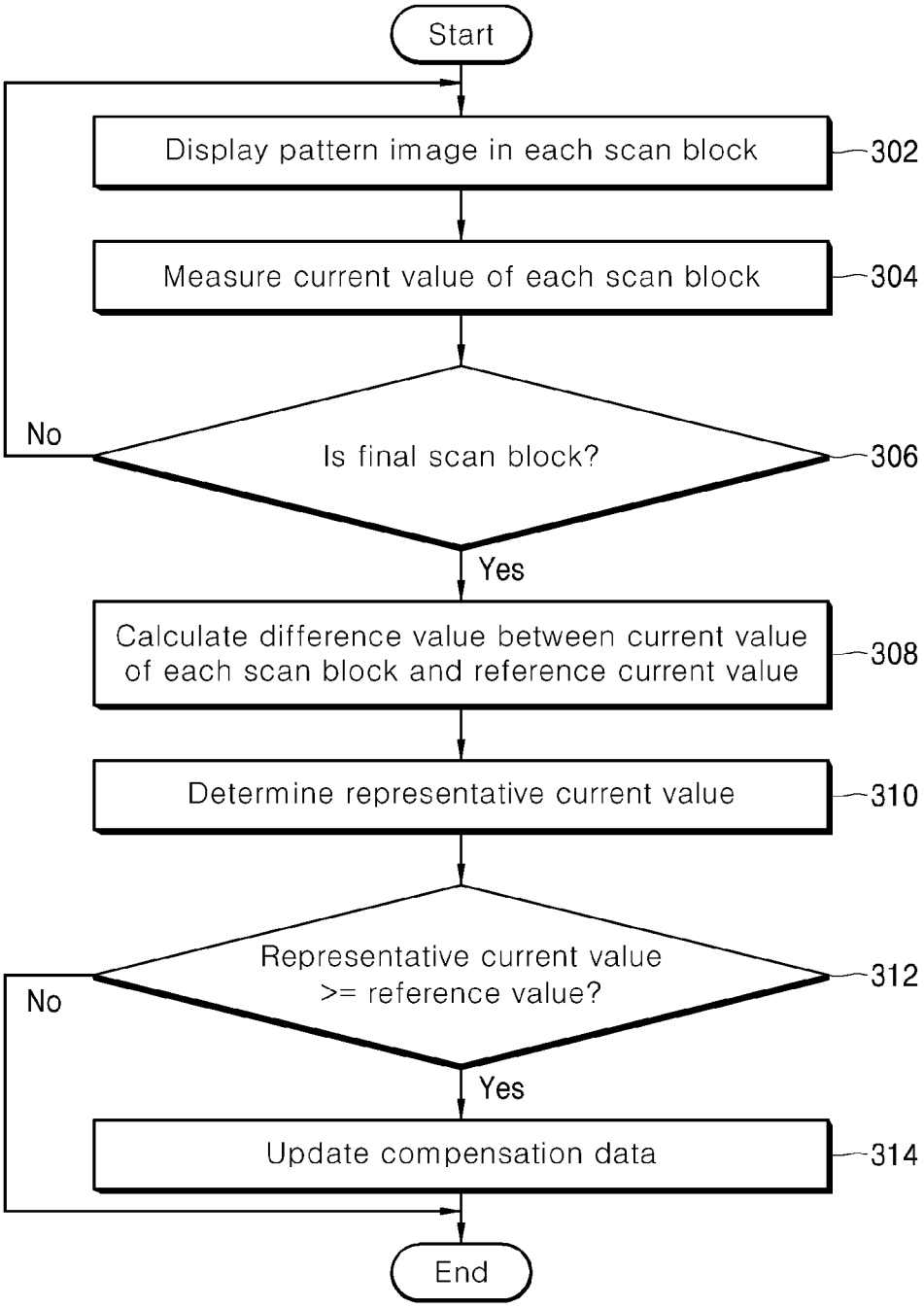
FIG. 3 is a flow chart illustrating a method for controlling a display device according to an embodiment.
Figure 4:
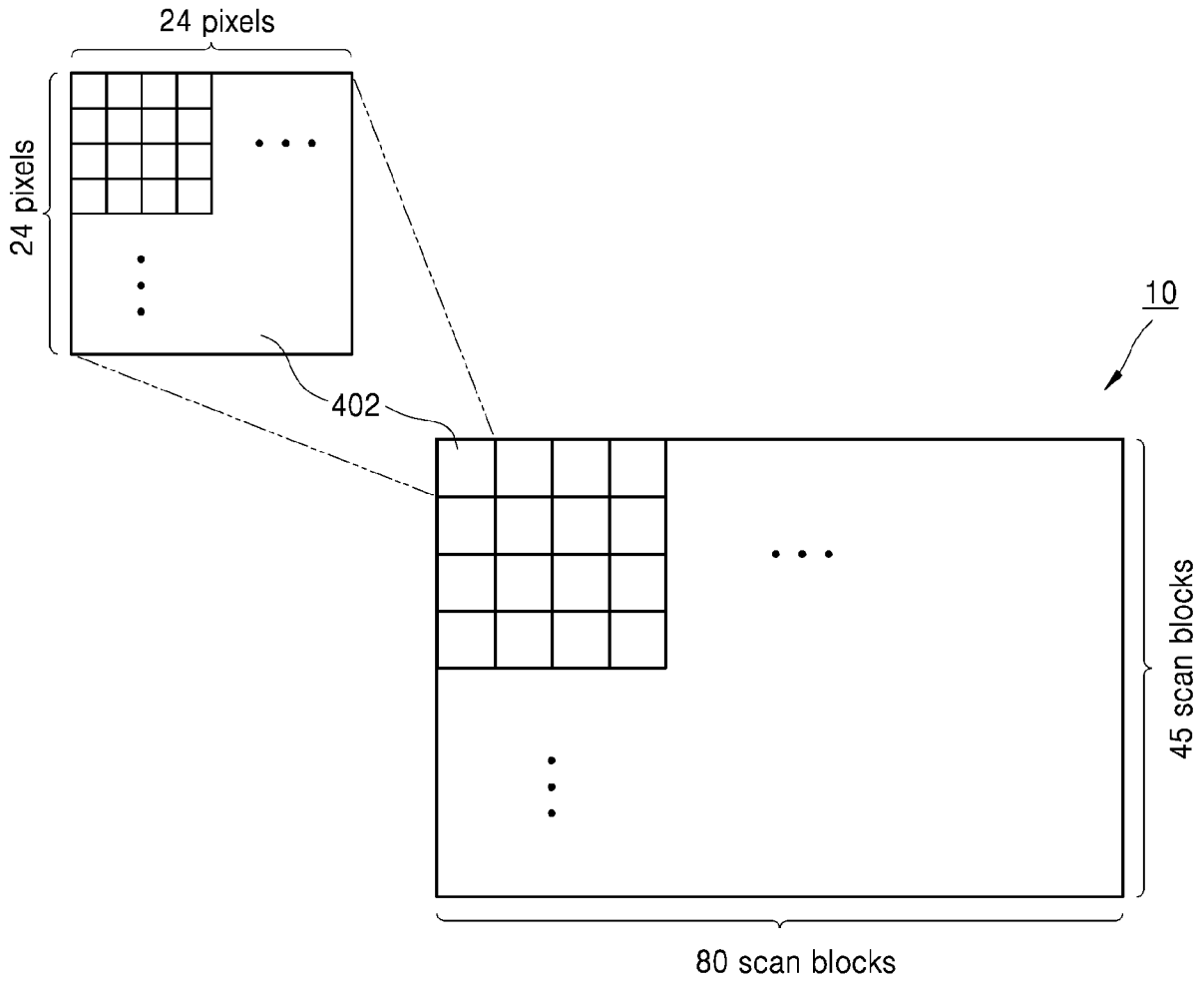
FIG. 4 illustrates a plurality of scan blocks set on a display panel in an embodiment.

FIG. 3 is a flow chart illustrating a method for controlling a display device according to an embodiment. FIG. 4 illustrates a plurality of scan blocks set on a display panel in an embodiment.

FIG. 4 illustrates an example where a plurality of scan blocks is set on the display panel 10. In the embodiment of FIG. 4, the display panel 10 has a resolution of 1920×1080 pixels, i.e., 1920 horizontal pixels and 1080 vertical pixels. In case a resolution of each scan block 420 is set to 24×24 pixels, 80 horizontal scan blocks and 45 vertical scan blocks may be set on the display panel 10, as in FIG. 4.

When the display device 1 is driven, a control method for compensating degradation of the display panel 10 illustrated in FIG. 3 may start at a predetermined time point (e.g., a time point when the display device 1 is turned off) or at a time point requested by a user. When the control method starts, a pattern image may be displayed on each of the plurality of scan blocks set on the display panel 10 (302).

In an embodiment, the pattern image may be an image having the same size and resolution as each scan block 402. The pattern image may be a single-color image having predetermined color and gradation values. However, another image may be used as the pattern image depending on embodiments.

The pattern image may be displayed consecutively or randomly on each scan block 402.

The current scan circuit 112 may measure magnitude of current flowing in the display panel 10 each time the pattern image is displayed on each scan block 402 (304). A current value of the display panel 10, which is measured each time the pattern image is displayed on each scan block 402, may be a current value of each scan block, and the current value may be transmitted to the timing controller 102.

The current scan circuit 112 may confirm whether a scan block 402 on which the pattern image is displayed is a final scan block, that is, whether the pattern image is displayed respectively on all the scan blocks 402 (306). In case the scan block 402 on which the pattern image is currently displayed is not a final one as a result of the confirmation (306), step 302 and step 304 may be performed again. Accordingly, current values of all the scan blocks may be measured.

In case the pattern image is displayed on all the scan blocks as a result of the confirmation (306), the timing controller 102 may calculate a difference between the current value of each scan block and a reference current value (308).

In an embodiment, the memory 108 may store a reference current value of the display panel 10. i.e., a reference current value of each scan block, which is measured while the pattern image is displayed on each scan block before shipment of the display device 1. Accordingly, in the embodiment of FIG. 4, 3,600 (80×45=3600) reference current values may be stored in the memory 108. The timing controller 102 may respectively calculate a difference between the current values of 3,600 scan blocks, which are measured in step 304, and the reference current value.

Next, the timing controller 102 may determine a representative current value of the display panel 10 on the basis of the difference between a current value of each scan block and the reference current value, which is calculated in step 308 (310).

The representative current value of the display panel 10 may be differently set depending on embodiments. As an example, a highest value or a lowest value among the differences between the current values of the scan blocks and the prestored reference current value may be set as the representative current value of the display panel 10. As another example, an average value of the differences between the current values of the scan blocks and the prestored reference current value may be set as the representative current value of the display panel 10.

The timing controller 102 may compare the representative current value with a predetermined reference value (312).

In case the representative current value is lower than the reference value as a result of the comparison (312), the timing controller 102 may determine not to update compensation data.

In case the representative current value is higher than the reference value as a result of the comparison (312), the timing controller 102 may determine to update the compensation data. Accordingly, the timing controller 102 may update compensation data of each pixel stored in the memory 108 (314).

In an embodiment, the timing controller 102, as described below, may update the compensation data of each pixel stored in the memory 108.

First, the timing controller 102 may add up the previously measured current value of each scan block and then may divide the added value by the number of scan blocks to calculate an average value of the current values of the scan blocks.

Next, the timing controller 102 may calculate a gain value of each scan block by dividing the calculated average value by the current value of each scan block. For example, in case an average value of the current values of the scan blocks, which is calculated in the embodiment of FIG. 4, is 10, and a current value, which is measured when the pattern image is displayed on the scan block 402, is 11, a gain value of the scan block 402 may be 10/11=0.9. Accordingly, gain values of all the scan blocks may be respectively determined.

When the gain value of each scan block is determined, the timing controller 102 may determine a gain value of each pixel included in each of the scan blocks on the basis of the gain value of each scan block. For example, in case a gain value of the scan block 402 is 0.9, a gain value of each pixel included in the scan block 402 may be 0.9.

In another embodiment, the timing controller 102 may adjust the gain value of each scan block through interpolation before determining the gain value of each scan block as the gain value of each pixel.

Through the above-described process, when the gain value of each pixel is determined, the timing controller 102 may multiply the compensation data of each pixel stored in the memory 108 by the gain value of each pixel to update the compensation data of each pixel. The updated compensation data of each pixel may be stored in the memory 108.

Then the timing controller 102 may modulate input image data (Idata) on the basis of the compensation data of each pixel stored in the memory 108, may generate the modulated input image data (Mdata), and may transmit the modulated input image data (Mdata) to the data driver 104. As a compensated image is displayed on the display panel 10 on the basis of the updated compensation data, image quality may improve.

The control method illustrated in FIG. 3 may be repeated. Thus, the compensation data stored in the memory 108 may continue to be updated considering degradation of the display panel 10.

Figure 5:
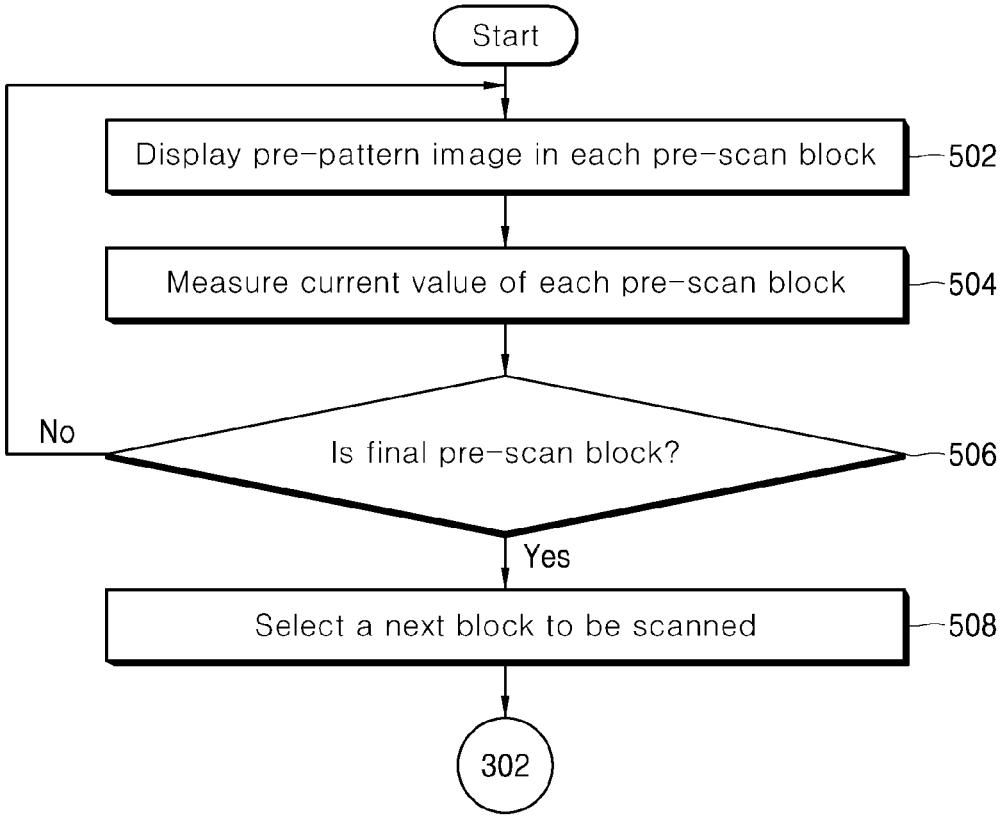
FIG. 5 is a flow chart illustrating a method for controlling a display device according to another embodiment.
Figure 6:
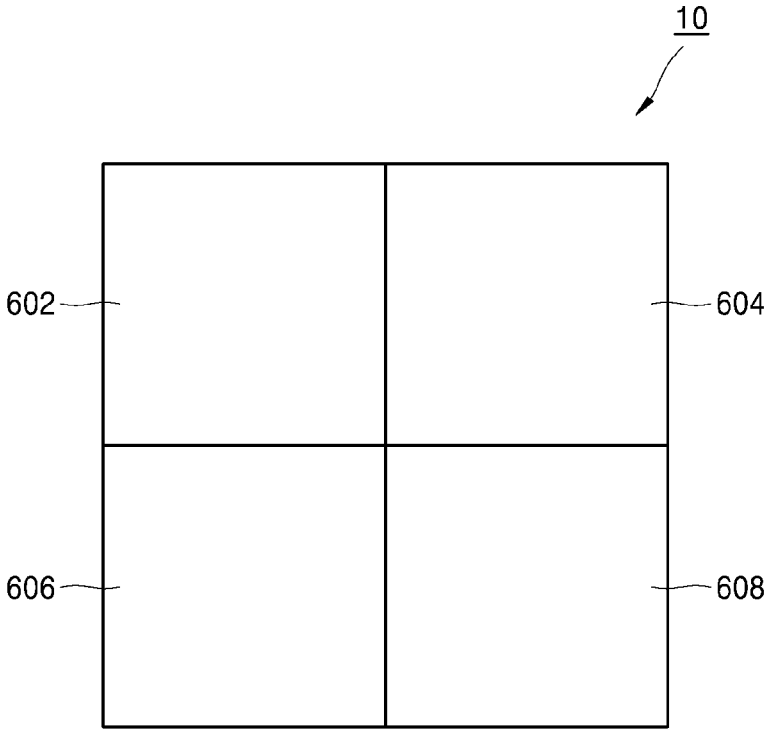
FIG. 6 illustrates a plurality of pre-scan blocks set on a display panel in another embodiment.

FIG. 5 is a flow chart illustrating a method for controlling a display device according to another embodiment. FIG. 6 illustrates a plurality of pre-scan blocks set on a display panel in another embodiment.

When the display device 1 is driven, a control method for compensating degradation of the display panel 10 illustrated in FIG. 5 may start at a predetermined time point (e.g., a time point when the display device 1 is turned off) or at a time point requested by a user.

In another embodiment, a pre-scan block is set on the display panel 10. As illustrated in FIG. 6, four pre-scan blocks 602, 604, 606, 608 may be set on the display panel 10. However, the size and number of pre-scan blocks may vary depending on embodiments.

In a state where the pre-scan blocks are set as in FIG. 6, a pre-pattern image may be displayed respectively on each pre-scan block (502).

In an embodiment, the pre-pattern image may be an image having the same size and resolution as each of the pre-scan blocks 602, 604, 606, 608. The pre-pattern image may be a single-color image having predetermined color and gradation values. However, another image may be used as the pre-pattern image depending on embodiments.

The pre-pattern image may be displayed consecutively or randomly on each of the pre-scan blocks 602, 604, 606, 608.

The current scan circuit 112 may measure magnitude of current flowing in the display panel 10 each time the pattern image is displayed on each of the pre-scan blocks 602, 604, 606, 608 (504). A current value of the display panel 10, which is measured each time the pre-pattern image is displayed on each of the pre-scan blocks 602, 604, 606, 608, may be a current value of each of the pre-scan blocks, and the current value may be transmitted to the timing controller 102.

The current scan circuit 112 may confirm whether a pre-scan block on which the pre-pattern image is displayed is a final one, i.e., whether the pre-pattern image is displayed respectively on all the pre-scan blocks (506). In case the pre-scan block on which the pre-pattern image is currently displayed is not a final one as a result of the confirmation (506), step 502 and step 504 may be performed again. Accordingly, current values of all the pre-scan blocks may be measured.

In case the pre-pattern image is displayed on all the pre-scan blocks as a result of the confirmation (506), the timing controller 102 may select at least one pre-scan block among the pre-scan blocks 602, 604, 606, 608 as a next block to be scanned (508).

In an embodiment, the timing controller 102 may respectively calculate a difference between a reference current value of each of the pre-scan blocks 602, 604, 606, 608 stored in the memory 108 and a current value of each of the pre-scan blocks 602, 604, 606, 608 measured by the current scan circuit 112. In an embodiment, the memory 108 may store a reference current value of the display panel 10, which is measured while the pre-pattern image is displayed on each pre-scan block before shipment of the display device 1, i.e., a reference current value of each pre-scan block. Accordingly, in the embodiment of FIG. 4, four reference current values may be stored in the memory 108. The timing controller 102 may respectively calculate a difference between the current values of the four pre-scan blocks, which are measured in step 504, and the reference current value.

The timing controller 102 may compare the calculated difference between the current value of each of the pre-scan blocks 602, 604, 606, 608 and the reference current value with a predetermined reference value. The timing controller 102 may select a pre-scan block, where the calculated difference is higher than or equal to the reference value, as a next block to be scanned. In step 508, one or more pre-scan blocks may be selected as the next block to be scanned.

The timing controller 102 may perform step 302 illustrated in FIG. 3 on the basis of the pre-scan block that is selected as the next block to be scanned through the above-described process in step 508. Accordingly, step 302 to step 314 illustrated in FIG. 3 may be performed with respect to the selected pre-scan block.

Figure 7:
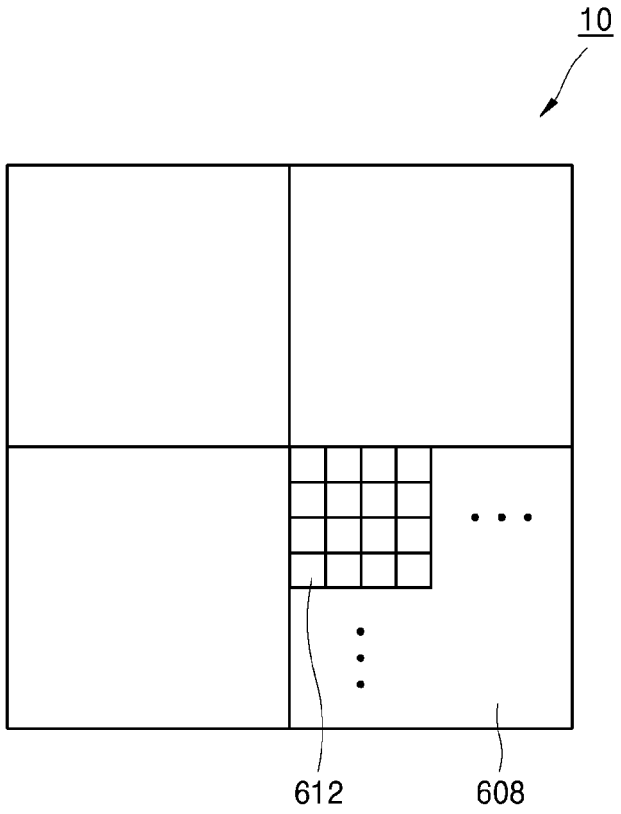
FIG. 7 illustrates a plurality of scan blocks set in a selected pre-scan block in another embodiment.

FIG. 7 illustrates a plurality of scan blocks set in a selected pre-scan block in another embodiment.

FIG. 7 illustrates an example where a pre-scan block 608 among the four pre-scan blocks 602, 604, 606, 608 illustrated in FIG. 6 is selected as a next block to be scanned. As described with reference to the embodiment of FIGS. 3 and 4, a plurality of scan blocks 612 may be set in the pre-scan block 608 selected as the next block to be scanned. That is, a plurality of scan blocks may be set in a single pre-scan block, and the plurality of scan blocks included in the pre-scan block may comprise one or more pixels.

For example, in case the display panel 10 has a resolution of 1920×1080 pixels in the embodiment of FIG. 7, the pre-scan block 608 may have a resolution of 480×270 pixels.

In case each scan block 612 included in the pre-scan block 608 has a resolution of 6×6 pixels, the pre-scan block 608 may include 3,600 (80×45=3,600) scan blocks. However, the size of the pre-scan block and the size of each scan block included in the pre-scan block may vary depending on embodiments.

Further, in an embodiment, a pre-scan block may be larger than a scan block.

In the embodiment of FIG. 7, when the pre-scan block 608 is selected as a next block to be scanned in step 508 of FIG. 5, the control method illustrated in FIG. 3 may be performed with respect to each scan block 612 included in the pre-scan block 608. Accordingly, compensation data of pixels included in each scan block 612 included in the pre-scan block 608 may be updated.

In the embodiment described with reference to FIG. 3, current values of all scan blocks set on the display panel 10 may be measured, and compensation data of all pixels included in the display panel 10 may be updated on the basis of the measured current values. Accordingly, each time the steps of the embodiment in FIG. 3 are performed, degradation may be compensated accurately with respect to all the pixels that constitute the display panel 10. In the embodiment of FIG. 3, in case the size of each scan block is configured to be smaller, degradation may be compensated more accurately.

Unlike the embodiment described with reference to FIG. 3, the embodiment described with reference to FIG. 5 may comprise selecting a specific pre-scan block from step 502 (the pre-scan process) to step 508 and updating the compensation data of the pixels included in the selected pre-scan block. The compensation data of the pixels included in the pre-scan block may only be updated. Accordingly, the embodiment of FIG. 5 enables faster detection of a degraded area and faster update of compensation data with respect to the degraded area than the embodiment of FIG. 3. Even in the embodiment of FIG. 5, as a size of each of the scan blocks included in the selected pre-scan block becomes smaller, the degradation of the selected pre-scan block may be more accurately compensated.

Figure 8:
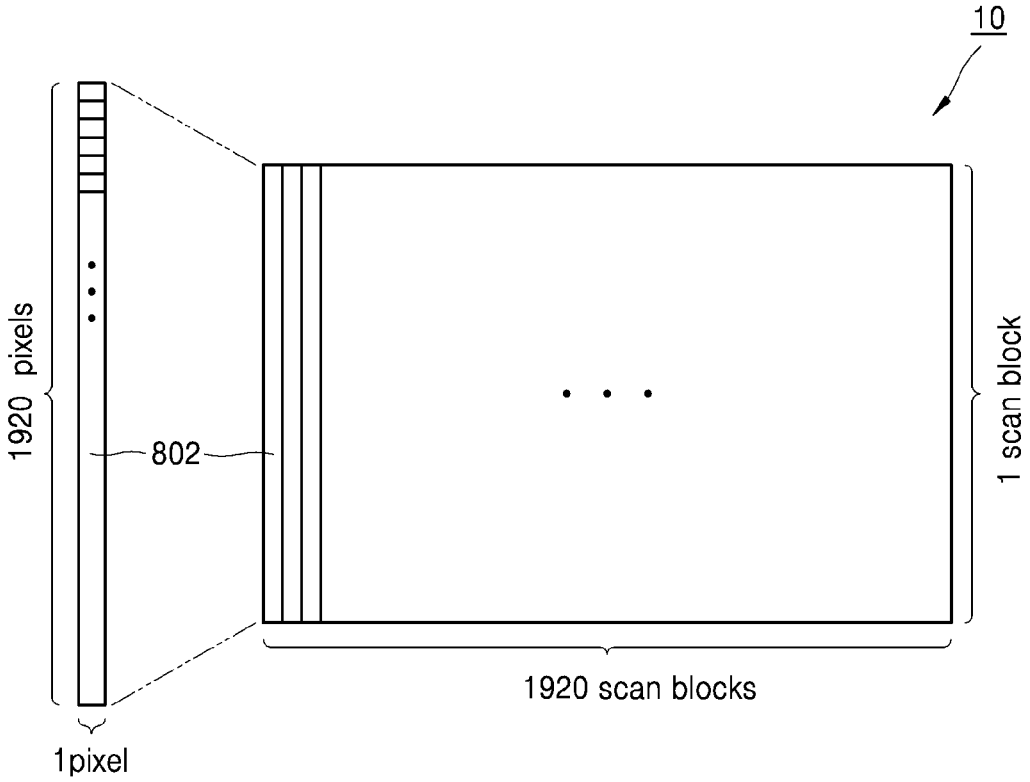
FIG. 8 illustrates a plurality of scan blocks set on a display panel in yet another embodiment.

FIG. 8 illustrates a plurality of scan blocks set on a display panel in yet another embodiment.

In the embodiment of FIG. 8, the display panel 10 may have a resolution of 1920×1080 pixels, and each scan block 802 may have a size of 1×1080 pixels. Accordingly, 1,920 (1920×1=1920) scan blocks may be set on the display panel 10.

In case step 302 to step 314 illustrated in FIG. 3 are performed in a state where the scan block is set as in FIG. 8, a defect of a line such as a bright line or a dark line may be detected or a defective line may be compensated.

Though not illustrated in FIG. 8, even when 1,080 scan blocks having a size of 1920×1 pixels are set on a display panel 10 having the same resolution as the display panel in FIG. 8, detection of a line defect and compensation of a defective line are possible as in FIG. 8.

The present disclosure has been described with reference to the embodiments and the drawings. However, the embodiments and drawings should not be interpreted as limiting the disclosure. It will be apparent to one having ordinary skill in the art that the embodiments may be replaced, modified and changed in various different forms within the technical scope of the disclosure. Thus, the scope of the present disclosure should be defined according to the appended claims, and all the technical idea within a scope equivalent to the claims should be interpreted as being included in the scope of the right to the present disclosure.

What is claimed is:

1. A method for controlling a display device, comprising:

displaying a pattern image respectively in a plurality of scan blocks set on a display panel;

measuring a current value of each of the plurality of scan blocks when the pattern image is displayed;

determining whether to update compensation data of each pixel included in each of the plurality of scan blocks based on a representative current value, wherein the representative current value is determined based on the current value of each of the plurality of scan blocks;

determining a gain value of each pixel included in each of the plurality of scan blocks based on the current value of each of the plurality of scan blocks when it is determined to update the compensation data; and updating the compensation data of each pixel based on the gain value of each pixel.

2. The method of claim 1, wherein determining whether to update compensation data of each pixel included in each of the plurality of scan blocks comprises:

comparing the representative current value with a predetermined reference value;

determining to update the compensation data of each pixel included in each of the plurality of scan blocks when the representative current value is higher than or equal to the reference value; and determining not to update the compensation data of each pixel included in each of the plurality of scan blocks when the representative current value is lower than the reference value.

3. The method of claim 1, wherein the representative current value is a highest value or a lowest value among differences between current values of the plurality of scan blocks and a prestored reference current value, or is an average value of the differences.

4. The method of claim 1, further comprising:

displaying a pre-pattern image respectively on a plurality of pre-scan blocks set on the display panel; and measuring a current value of each of the plurality of pre-scan blocks when the pre-pattern image is displayed; and setting the plurality of scan blocks in at least one pre-scan block from the plurality of pre-scan blocks selected based on the current value of each of the plurality of pre-scan blocks.

5. The method of claim 1, wherein determining the gain value of each pixel included in each of the plurality of scan blocks comprises:

calculating an average value of current values of the plurality of scan blocks;

determining a gain value of each of the plurality of scan blocks based on the average value; and determining a gain value of each pixel included in each of the plurality of scan blocks based on the gain value of each of the plurality of scan blocks.

6. The method of claim 5, wherein determining the gain value of each pixel included in each of the plurality of scan blocks based on the gain value of each of the plurality of scan blocks comprises:

determining a gain value of each pixel included in each of the plurality of scan blocks by interpolating a gain value of each of the plurality of scan blocks.

7. A display device, comprising:

a display panel comprising a plurality of pixels;

a data driver configured to drive a data line of the display panel;

a gate driver configured to drive a gate line of the display panel;

a timing controller configured to control driving of the data driver and the gate driver; and a power supply configured to supply a power voltage to the display panel; and a current scan circuit connected between the display panel and the power supply, and configured to measure magnitude of current flowing in the display panel when an image is displayed on the display panel, wherein the timing controller is configured to determine a representative current value based on a current value of each scan block, which is measured when a pattern image is displayed respectively on a plurality of scan blocks set on the display panel, to determine whether to update compensation data of each pixel included in each of the plurality of scan blocks based on the representative current value, to determine a gain value of each pixel included in each of the plurality of scan blocks based on the current value of each of the plurality of scan blocks when it is determined to update the compensation data, and to update the compensation data of each pixel based on the gain value of each pixel.

8. The display device of claim 7, wherein the timing controller is configured to compare the representative current value with a predetermined reference value, to determine to update the compensation of each pixel included in each of the plurality of scan blocks when the representative current value is higher than or equal to the reference value, and to determine not to update the compensation data of each pixel included in each of the plurality of scan blocks when the representative current value is lower than the reference value.

9. The display device of claim 7, wherein the representative current value is a highest value or a lowest value among differences between the current values of the plurality of scan blocks and a prestored reference current value, or is an average value of the differences.

10. The display device of claim 7, wherein the timing controller is configured to set the plurality of scan blocks in at least one pre-scan block selected based on the current value of each of the plurality of pre-scan blocks, which is measured when a pre-pattern image is displayed respectively on the plurality of pre-scan blocks set on the display panel.

11. The display device of claim 7, wherein the timing controller is configured to calculate an average value of current values of the plurality of scan blocks, to determine a gain value of each of the plurality of scan blocks based on the average value, and to determine a gain value of each pixel include in each of the plurality of scan blocks based on the gain value of each of the plurality of scan blocks.

12. The display device of claim 11, wherein the timing controller is configured to determine a gain value of each pixel included in each of the plurality of scan blocks by interpolating a gain value of each of the plurality of scan blocks.

* * * * *